United States Patent [19]

Clark

[11] Patent Number: 4,745,776

[45] Date of Patent: May 24, 1988

[54] SINGLE CAN COOLER

[76] Inventor: Wilbert P. Clark, 720 W. Imperial, #101, El Segundo, Calif. 90245

[21] Appl. No.: 16,070

[22] Filed: Feb. 18, 1987

[51] Int. Cl.[4] ..... F25D 3/08

[52] U.S. Cl. ..... 62/457; 62/372

[58] Field of Search ..... 62/371, 372, 457, 529, 62/530, 430, 60; 220/428, 903

[56] References Cited

U.S. PATENT DOCUMENTS

| | | | |
|---|---|---|---|
| 1,963,743 | 6/1934 | Hoodless | 62/372 |
| 3,302,427 | 2/1967 | Stoner et al. | 62/457 |
| 3,302,428 | 2/1967 | Stoner et al. | 62/457 |
| 3,807,194 | 4/1974 | Bond | 62/457 |
| 3,974,658 | 8/1976 | Starrett | 62/60 |
| 4,037,428 | 7/1977 | Giannotti | 62/371 |
| 4,211,091 | 7/1980 | Campbell | 62/372 |
| 4,295,345 | 10/1981 | Atkinson | 62/371 |
| 4,383,422 | 5/1983 | Gordon et al. | 220/231 |
| 4,577,474 | 2/1985 | Peterson | 62/457 |

*Primary Examiner*—Lloyd L. King

*Attorney, Agent, or Firm*—Freilich, Hornbaker, Rosen & Fernandez

[57] ABSTRACT

A cooler is provided for a typical carbonated beverage can, which facilitates cooling of the can and drinking of beverage from the cold can. The cooler includes a container bottom assembly which closely receives the can and a top assembly which fits into the bottom assembly to trap a can therein. About two-thirds of the height of the can lies in the bottom assembly, and the bottom assembly closely surrounds the can, to keep the can cool even when the top is removed and liquid is drunk from the can lying in the bottom assembly. The bottom assembly includes a refrigerant element having a raised middle portion which is received in the concave bottom of a typical pressurized twelve ounce can. The bottom assembly includes a hard cup-shaped shell and a cup-shaped foam liner, the bottom of the liner being closely held in the shell but the top of the liner being spaced from the shell to provide space for an interfitting lip on the top assembly.

4 Claims, 1 Drawing Sheet

FIG. 1
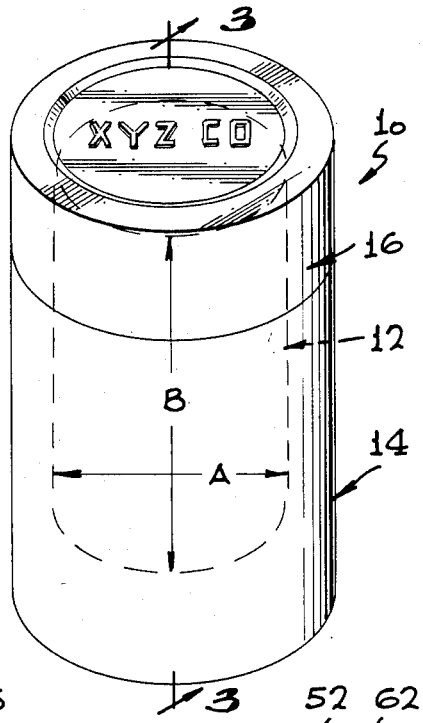
FIG. 2
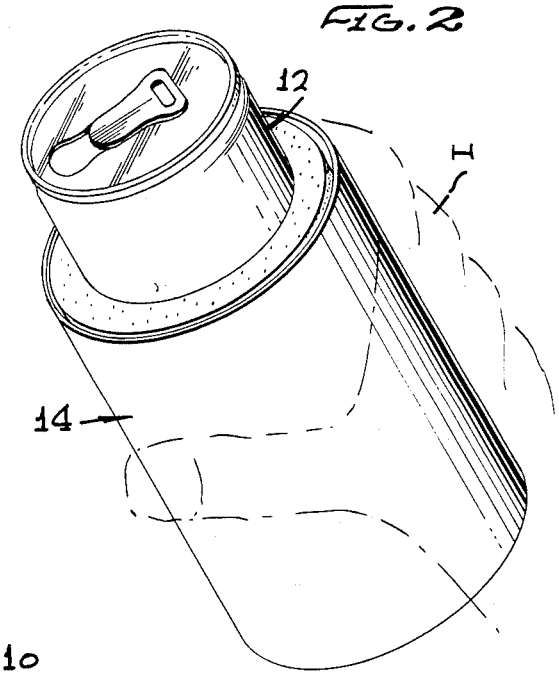
FIG. 3
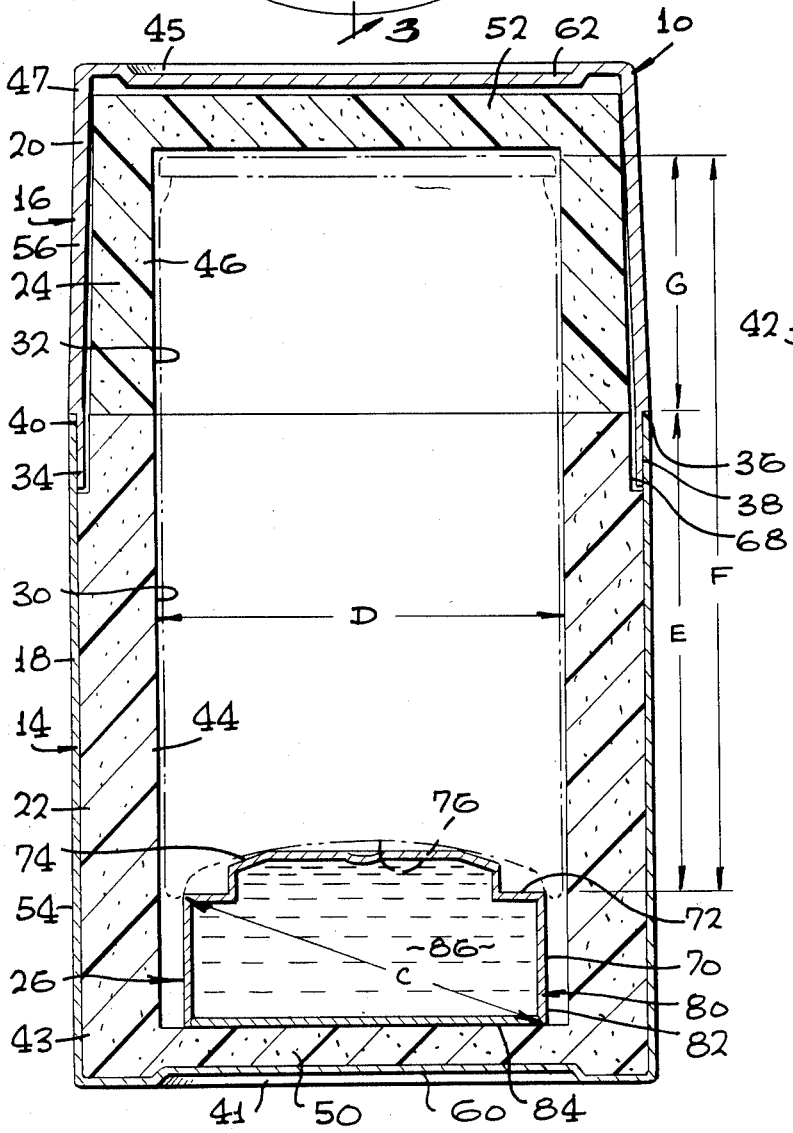
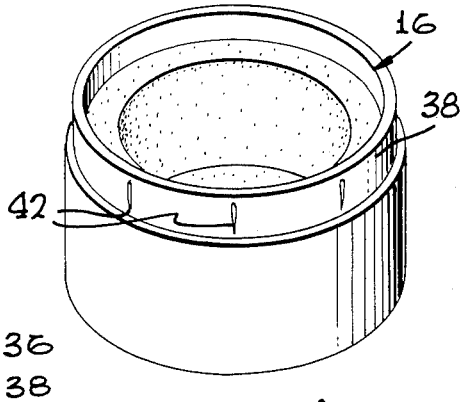
FIG. 5
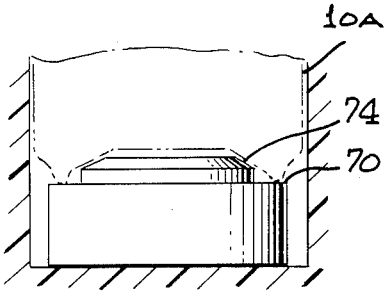
FIG. 4

SINGLE CAN COOLER

BACKGROUND OF THE INVENTION

Cans containing carbonated beverages are generally sold in twelve ounce cans of a typical or "standard" overall size, of a height of 4-13/16ths inch (12.2 cm) and a diameter of 2⅝ths inch (6.6 cm). An insulated container which could keep a single soda can cold in hot weather, which was efficient in keeping the can cool and which facilitated drinking from a cold can, would be of considerable value.

SUMMARY OF THE INVENTION

In accordance with one embodiment of the present invention, a cooler is provided for holding a single typical twelve ounce can, which is effective in keeping the can cool and which facilitates use. The cooler includes an insulated container bottom assembly which has a hollow inside for receiving a can, and a top assembly which also has a hollow inside for receiving the upper portion of a can and a lower portion which interfits with the bottom assembly. The bottom assembly can have a deep enough hollow inside to hold over 60% of the height of the can, while the hollow inside of the top assembly is only tall enough to receive the rest of the can. This results in a cooler of minimum height when closed around the can, and yet most of the height remains around the can when the top is off to still keep the can cool. The bottom assembly can include a refrigerant element which can be frozen, with the element having a raised top middle portion which is received in the concave bottom of a typical can of a carbonated beverage.

The top and bottom assemblies can each include a cup-shaped rigid shell and a cup-shaped foam liner which lies within the shell. The lip on one of the shells, such as the top shell, can include a recess at its outside for fitting into the lip of the other shell. The cup-shaped liner of the bottom assembly can lie in interference fit with the inside of the shell, while the top of the liner is spaced from the top of the shell, to leave a space between them that receives the lip on the top assembly and which creates a dead airspace for better insulation.

The novel features of the invention are set forth with particularity in the appended claims. The invention will be best understood from the following description when read in conjunction with the accompanying drawings.

BRIEF DESCRIPTION OF THE DRAWINGS:

FIG. 1 is a perspective view of a cooler constructed in accordance with the present invention and holding a twelve ounce can, shown in a closed condition.

FIG. 2 is a perspective view of the cooler of FIG. 1, shown in an open position.

FIG. 3 is a view taken on the line 3—3 of FIG. 1.

FIG. 4 is a view of a portion of the cooler of FIG. 3, but showing it with a can having a differently shaped bottom.

DESCRIPTION OF THE PREFERRED EMBODIMENTS:

FIGS. 1 and 2 illustrate a cooler 10 for holding a typical can 12 of a type which contains a carbonated beverage such as beer or soda. While numerous brands of soda are sold in cans, substantially all of such cans have about the same diameter A and overall height B of about 2.6 inches and 4.8 inches, respectively. The cooler 10 includes a container bottom assembly 14 and a container top assembly 16 which can be closed around the can to keep it cool for an extended period of time. When the contents of the can are to be drunk, the top assembly 16 is pulled off, and the top of the can is open while the can remains in the bottom assembly 14. Most of the can still lies within the bottom assembly 14 to keep the can cool for an extended period during which it may stand idle in hot weather. A person holds the bottom assembly in his hand H as shown in FIG. 2 to drink the beverage.

As shown in FIG. 3, the top and bottom assemblies each includes a cup-shaped rigid plastic shell 18, 20 and a cup-shaped styrofoam liner 22, 24. A refrigerant element 26 lies at the inside of the bottom of the bottom iner, to provide a heatsink for receiving heat to minimize heating of the can and its contents. The bottom and top assemblies each forms a hollow inside 30, 32 which closely receives the can.

The top shell 20 includes a lip portion 34 which is instepped at 36 to form the lower lip portion with a reduced diameter or indented region at 38 along a length of about one-half inch extending to the extreme tip of the lip portion. The instepped lip portion can fit snugly within the lip portion 40 of the bottom assembly, to form an interfitting connection that holds the top and bottom assemblies tightly together to prevent their accidental separation and to provide a barrier to the flow of air between the inside and outside of the cooler. Thin ribs 42 molded on the outside of the reduced diameter portion or indented region 38 of the top assembly assure a fairly tight fit despite wear from repeated opening and closing of the cooler.

The bottom assembly includes a bottom end 41 and side walls 43, and the top assembly includes a top end 45 and side walls 47. Each of the liners 22, 24 includes side walls 44, 46 that are cylindrical on their inside and outside, and an end wall 50, 52 that are substantially flat. Each shell 18, 20 includes a largely cylindrical side wall 54, 56 has a primarily flat end wall 60, 62. Theside walls 54 of the lower shell are tapered in diameter, with the largest diameter at the lip portion 40. The side walls of the top shell 20 are similarly tapered in diameter. The liners are similarly tapered. Each liner is easily inserted along most of its depth while aligned with the shell, and is inserted into an interference fit with the shell only near the end of its insertion. The top of the bottom liner is instepped at 68 at its periphery, to provide space for receiving the lip portion 34 of the top shell.

The refrigerant element 26 has substantially cylindrical side walls and a substantially cylindrical periphery, and has a substantially flat outer top 72 on which the periphery of a can bottom can rest or lie against. The element also has a raised middle top portion 74 of smaller width than the element periphery 70, and which is designed to be received in a recess 76 at the bottom of a pressured carbonated-beverage can. A typical pressured can 12 has a concave bottom or recess 76 that makes the bottom more rigid against deflection under the pressure within the can. Either the outer top 72 or raised middle top portion 74 may form a can-supporting wall of the bottom assembly, on which the can rests. The raised top portion 74 has several advantages, including providing an additional volume for holding refrigerant, and allowing more of the outside of the refrigerant element to lie close to the can to conduct heat from the can. The element 26 includes a housing 80 formed by a pair of parts 82, 84. The element also includes a quantity of a refrigerant 86 of a type similar to water, which has a high specific heat, melts at a temperature that is a plurality of tens of degrees below room temperature but above a temperature of about 0° F. obtainable in a freezer, and which requires considerable heat to melt.

The diagonal dimension C of the element, as measured between points lying on diametrically opposite sides of the cylindrical periphery of the element at opposite ends of the cylindrical periphery, is preferably no greater than the diameter D of the bottom liner. This avoids the referigerant element from becoming stuck in the foam bottom liner when the element is cocked, during insertion or withdrawal. The element can easily be removed by turning the bottom assembly upside down, to allow the element to be placed in a freezer where the refrigerant therein can become frozen for later use. No refrigerant element is placed in the top assembly 16, because such an element would fall out whenever the top assembly was removed and because it would add to the height of the cooler. Also, such an element in the top assembly would be less effective than one in the bottom assembly. The top assembly is constructed so the can lies within about one-fourth inch of the top of the hollow inside.

The refrigerant element 26 is especially effective in the bottom assembly because the height E of the bottom assembly above the bottom of the can is more than one-half the height F of the can. This leaves only a relatively small height G of the can exposed to the environment when the top assembly is removed. Applicant prefers that the enclosed can height E be greater than 60% of the total can height. This results in less heating of the can by the environment, and still provides a considerable exposed height G of the can, of at least one-fourth the can height, for permitting a person to drink from the can while it still lies in the bottom assembly. The refrigerant element 26 at the bottom of the bottom assembly is especially effective, in that cold air tends to fall rather than rise, so there are minimal convection currents along the long space 85 between the can and liner. In a cooler applicant has constructed, the enclosed can height E is two-thirds the height F of the can.

FIG. 4 illustrates the bottom of another common can 10A, wherein the extreme bottom of the can has a smaller diameter than most of the can. This allows the extreme can bottom to lie directly on the outer top 70 of the refrigeration element, while the raised middle top portion 74 lies in the recessed can bottom.

Thus, the invention provides a cooler for use with a can of typical size that contains a carbonated beverage, which is relatively compact and easy to use, and which keeps the beverage cool for an extended period of time. The cooler includes top and bottom assemblies forming a hollow inside for closely surrounding a can, with the bottom assembly surrounding more than one-half the height of the can, and preferably at least about 60%, or at least about two-thirds the can height, to keep the can cool for an extended period of time. A refrigerant element of the bottom assembly includes a raised middle top portion which is received in the recess formed at the bottom of a typical pressured beverage can. The top shell has an indented lip which is received at the lip of the bottom shell, and a space lies between the bottom liner and bottom shell for receiving the indented portion, for providing additional insulation, and for enabling easy insertion and removal of the bottom liner.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A beverae cooler which can keep a beverage-filled can of predetermined diameter cool for an extended period of time while facilitating the drinking of a beverage from the still-cold can comprising:

a hollow heat insulated container bottom assembly which includes a bottom end and side walls, and having a hollow inside with a can-supporting wall for supporting the bottom of said can;

a hollow heat insulated container top assembly which includes a top end, and which includes side walls which closely mate with the side walls of said bottom assembly to form a can-holding container which avoids the passage of air between the outside and inside of the container to thereby avoid convective heating;

said bottom assembly formed to closely surround said can along most of the height of the can to avoid can rattling when the bottom assembly is tilted, and the height of the hollow inside of said bottom assembly above said can-supporting wall being greater than the hollow inside of said top assembly and of a height more than 60% of the height of said can but no more than 75% of the height of said can to leave at least 25% of the top of the can free, whereby to facilitate drinking directly from the can while it lies in the bottom assembly;

said top assembly forming a recess that receives at least the upper 25% of the height of said can.

2. The cooler described in claim 1 wherein:

said bottom assembly includes a refrigerant element which can fit into the hollow inside of said bottom assembly and lie at the bottom of said hollow inside, said element having a periphery and a raised top of smaller width than said periphery, for reception in a recess at the bottom of a typical carbonated beverage can.

3. The cooler described in claim 1 wherein:

said container bottom assembly and container top assembly each includes a cup-shaped liner of molded foam and a hard plastic cup surrounding said liner, one of said hard plastic cups having a lip portion which is instepped and the other cup formed to fit closely over said instepped lip portion, said instepped lip portion fitting between the foam liner and the lip portion of the other assembly.

4. The cooler described in claim 5 wherein:

the cup of said top assembly is the cup which has an instepped lip;

said bottom assembly cup-shaped foam liner has open and closed ends, the closed end being closely held in at least slight interference fit in the corresponding hard plastic cup so the liner does not fall out when the open liner end faces down, but there is a space between a top portion of the cup and liner of the bottom assembly, which can receive the instepped lip of the top assembly cup.

* * * * *